United States Patent [19]

Beck et al.

[11] 4,151,808

[45] May 1, 1979

[54] APPARATUS FOR SPRAYING ARTICLES CARRIED BY A CONVEYOR

[75] Inventors: Alfred E. Beck, Exeter; Richard D. Cushing, Newton, both of N.H.

[73] Assignee: Circle Machine Co., Inc., Seabrook, N.H.

[21] Appl. No.: 776,105

[22] Filed: Mar. 10, 1977

[51] Int. Cl.[2] ..... B05B 3/02

[52] U.S. Cl. ..... 118/2

[58] Field of Search ..... 118/2

[56] References Cited

U.S. PATENT DOCUMENTS

| | | | |
|---|---|---|---|
| 2,754,795 | 7/1956 | Enssle | 118/2 |
| 2,971,492 | 2/1961 | Enssle | 118/2 |
| 3,013,445 | 12/1961 | Enssle | 118/2 X |
| 3,029,774 | 4/1962 | Namenyi-Katz | 118/2 |
| 3,034,475 | 5/1962 | Bowman | 118/2 |
| 3,426,973 | 2/1969 | Ordway | 239/66 |
| 3,908,592 | 9/1975 | Ordway et al. | 118/313 |

FOREIGN PATENT DOCUMENTS

| | | | |
|---|---|---|---|
| 1280969 | 11/1961 | France | 118/2 |
| 6605823 | 10/1964 | Netherlands | 118/2 |
| 835670 | 5/1960 | United Kingdom | 118/2 |
| 854704 | 11/1960 | United Kingdom | 118/2 |
| 954946 | 4/1964 | United Kingdom | 118/2 |

*Primary Examiner*—Robert Mackey

[57] ABSTRACT

Apparatus for use in spraying articles, hides for one example, while being carried on a conveyor has a rotatable spray unit supported over the conveyor and its radial arms are provided with spray heads, each under the control of a normally closed valve opened by air under pressure. A series of controls are provided, each including a sensing unit and the sensing units are arranged as a series extending transversely of the conveyor and dividing the conveyor into lengthwise sections with each unit operated by the passage of a part of a hide along that section and when operated providing a signal substatially equal to the length of that part and so controlling the delivery of air to the control valve of each head traversing that conveyor section as to provide that spray is delivered only when and for the time that the detected part is within the spray path.

15 Claims, 11 Drawing Figures

Fig. 3
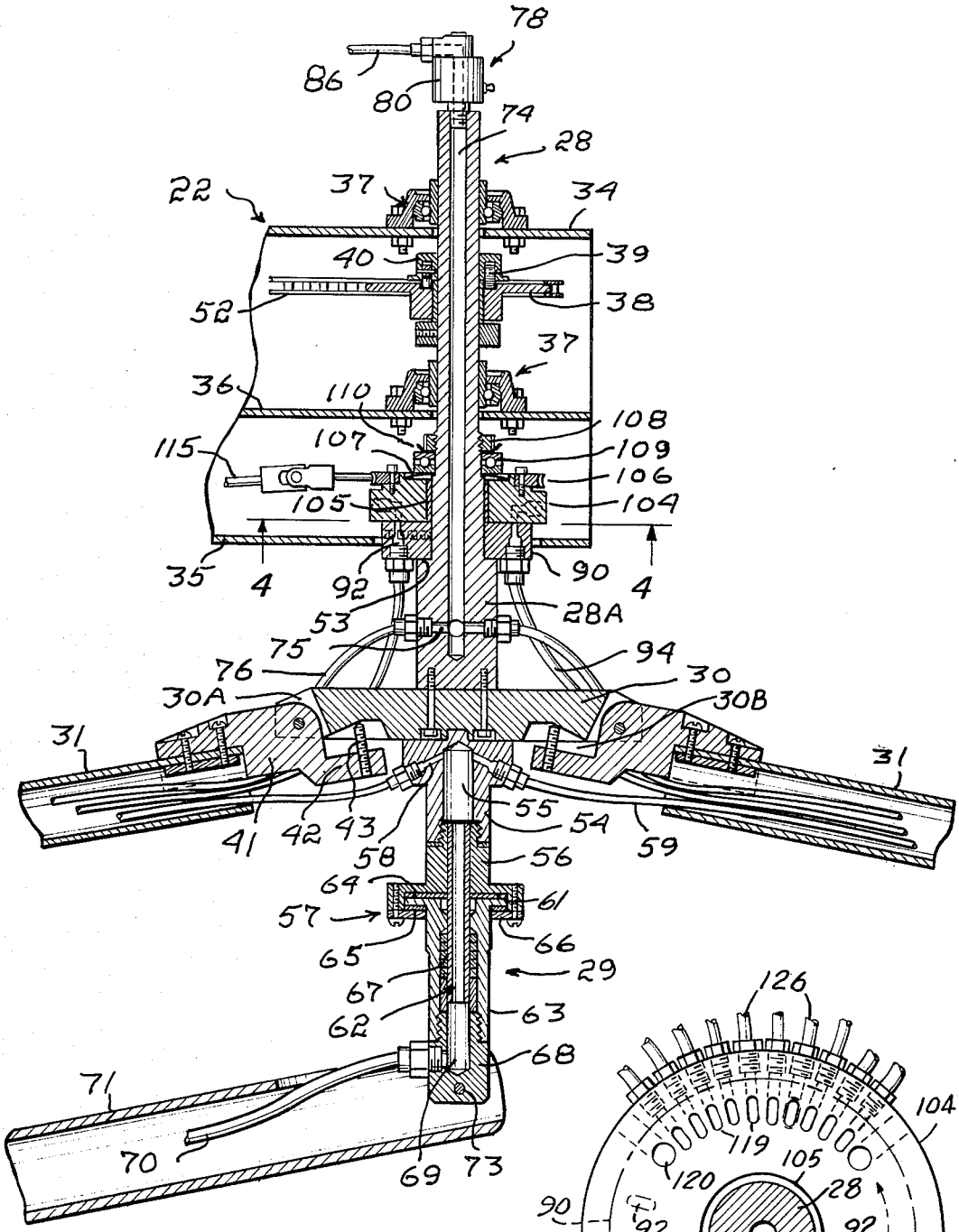
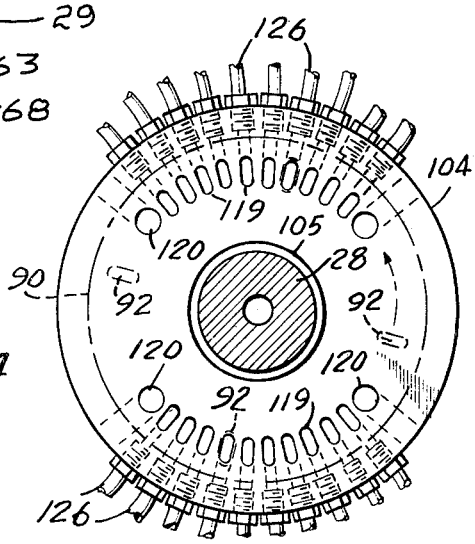
Fig. 4

76
94
59
31
33
32

33
100
98
99

93
PULSE
97
FLUID
60
95
AIR
77
103
32
101
102
96

81
85
86
80

84
83
78
82
79
28
74

24A
88
AIR SUPPLY
149
155
139

134
133
131
127
AIR SUPPLY
125
171
138
129
128
173
132
126
130
140
137
167
166
170
126
127
125
165
134
139
AIR SUPPLY
133
168
172
133
126
AIR SUPPLY
28
136
91
135
104
90
33
33
133
32
94
29
32
SPRAY FLUID
70

APPARATUS FOR SPRAYING ARTICLES CARRIED BY A CONVEYOR

BACKGROUND REFERENCES

U.S. Pat. Nos. 2,754,795, 3,908,592, 3,426,973, and 3,034,475.

BACKGROUND OF THE INVENTION

Problems attendant the coating of or otherwise treating articles with sprays while being carried on a conveyor are well illustrated when the articles are hides or half hides and while the present invention is discussed and detailed with particular reference to the coating of hides and half hides, such references are by way of example only and not of limitation.

It has long been the practice to provide sprayers of the type having a rotatable spray unit positioned over a conveyor and provided with a plurality of spray heads supported a predetermined distance from the axis thereof. In order to ensure uniformity of the applied coat, the arms are typically of a length considerably more than half of the width of the conveyor in order that the path of the spray heads may be as near straight as is consistent with coat, space limitations and like practical considerations.

As a consequence, it is necessary to control the delivery of the coating material or materials in order not to discharge such materials laterally of the conveyors. Such control, as in the case of U.S. Pat. No. 3,908,592 also permitted the width of the coat application relative to the conveyor to be varied.

With all such rotary spray units, the spray was delivered continuously through a predetermined arcuate part of the spray path upstream of the unit and usually a like part of the spray path downstream thereof or through both parts. As the hides being coated are spaced apart often with substantial gaps between them, the amount of wasted coating materials is substantial and is an important factor that has long been recognized. Proposals have been made to conserve coating materials by utilizing light sensitive means responsive to the presence of hides in the spray path to control spraying and also electronic spraying controls responsive to switches closed by the hides. As far as we are aware, however, it has been preferred, for practical reasons, to minimize spray material waste by shutting off fluid delivery completely unless a hide is on the conveyor and approaching the spray path by utilizing a sensing unit disposed transversely of the conveyor and rendered operable by a hide or half hide to deliver an air signal to a control unit to render a chain, continuously driven by the conveyor, effective to operate the shutoff means.

The PRESENT INVENTION

The general objective of the present invention is to provide a rotatable spray unit and control therefor by which the spray is effected only in the lengthwise section or sections of the conveyor on which a part of an article is present and for the interval in which that part is within the path of the spray heads.

Although the invention is described with particular reference to hides or half hides, the term "article" as used herein means, in addition thereto, any articles that can be sprayed advantageously while being carried by a conveyor and particularly pieces of sheet materials of which plastic pieces are an important example.

In accordance with the invention, this objective is attained with the shaft of the rotatable spray unit having in addition to a rotary joint or joints for the delivery of spray material or materials, typically a liquid and atomizing air, a rotatable air delivery joint, the rotatable part of which is provided with a port for each arm and in communication with a normally closed, spray control valve that is opened by air under pressure then to permit the discharge of the wanted spray from the spray head carried by that arm.

Each of a series of controls includes a sensing unit and the sensing units are arranged as a series extending transversely of the infeed end of the conveyor and, in effect, dividing the conveyor, for spraying purposes, into a like number of lengthwise sections. The stationary ring of the rotary air delivery joint is provided with at least one arcuate series of ports, one port for each of the lengthwise conveyor sections, two such series being provided when spray is to be delivered both upstream and downstream relative to the spray unit axis, and each port of the rotatable part of that joint is in communication successively with the ports of said series as the shaft turns. A series of air delivery conduits is provided, one for each stationary ring port that represents a lengthwise conveyor section and in communication therewith and each is valve controlled. Each of the series of controls responds to the operation of its sensing unit as a part of an article passes and effects the operation of each air delivery valve in a manner ensuring the operation of each spray head traversing the section of the conveyor along which the sensed part is travelling but only while that part is within the spray path.

In practice, the stationary ring has two arcuate series of ports, one for upstream and the other for downstream spraying and a particular objective of the invention is to provide that the means holding the stationary ring enables it to be so turned that its series of ports may be properly related to the lengthwise sections of the conveyor.

The sensing units of the conrols may be mechanically, electrically, or air operated or by combination thereof. For examples, the sensing units may be operated by fingers, if the conveyor is of the type consisting of a transversely spaced series of endless members between which the fingers may extend, by photoelectric cells, since the sensing units may be spaced well away from the spray path, or by means providing an air feedback signal resulting when an air stream is intercepted by a part of an article.

The means of the conrols operated by the sensing units in response to a sensed article part that operate the delivery valves in the air delivery conduits to the ring of the air delivery joint may be of any type provided that they are capable of operating on a "memory" basis such that the air delivery conduits are open to the rotatable air delivery joint whenever spray heads are traversing a lengthwise conveyor section in which there is a part of an article in the spray path.

An important objective of the invention is to provide for the operation of the rotatable spray unit on a basis ensuring that spraying will stop if the controls fail. This objective is attained with each air delivery conduit provided with a three way valve normally open to the rotatable air delivery joint but held closed and open to relief by the associated control unless the sensing unit thereof is operated and until the detected part of the article reaches and passes through the spray path. A particular objective of the invention is to have such operation of each air delivery conduit valve effected by air under pressure with each control having a conduit in communication with the appropriate air delivery valve and provided with a three way operating valve that is normally open to hold the delivery valve open to relief but is operated by the control of which it is a part to set the associated operating valve into its relief position for the proper interval, as determined by any signal from the sensing unit of that control, for the sensed article part to reach the spray path.

BRIEF DESCRIPTION OF THE DRAWINGS

In the accompanying drawings, preferred embodiments of the invention are illustrated

FIG. 3 is a section, on an increase in scale, taken approximately along the indicated line 3—3 of FIG. 1;

FIG. 4 is a section, on a further increase in scale, taken approximately along the indicated line 4—4 of FIG. 3;

THE PREFERRED EMBODIMENT OF THE INVENTION

Figure 1:
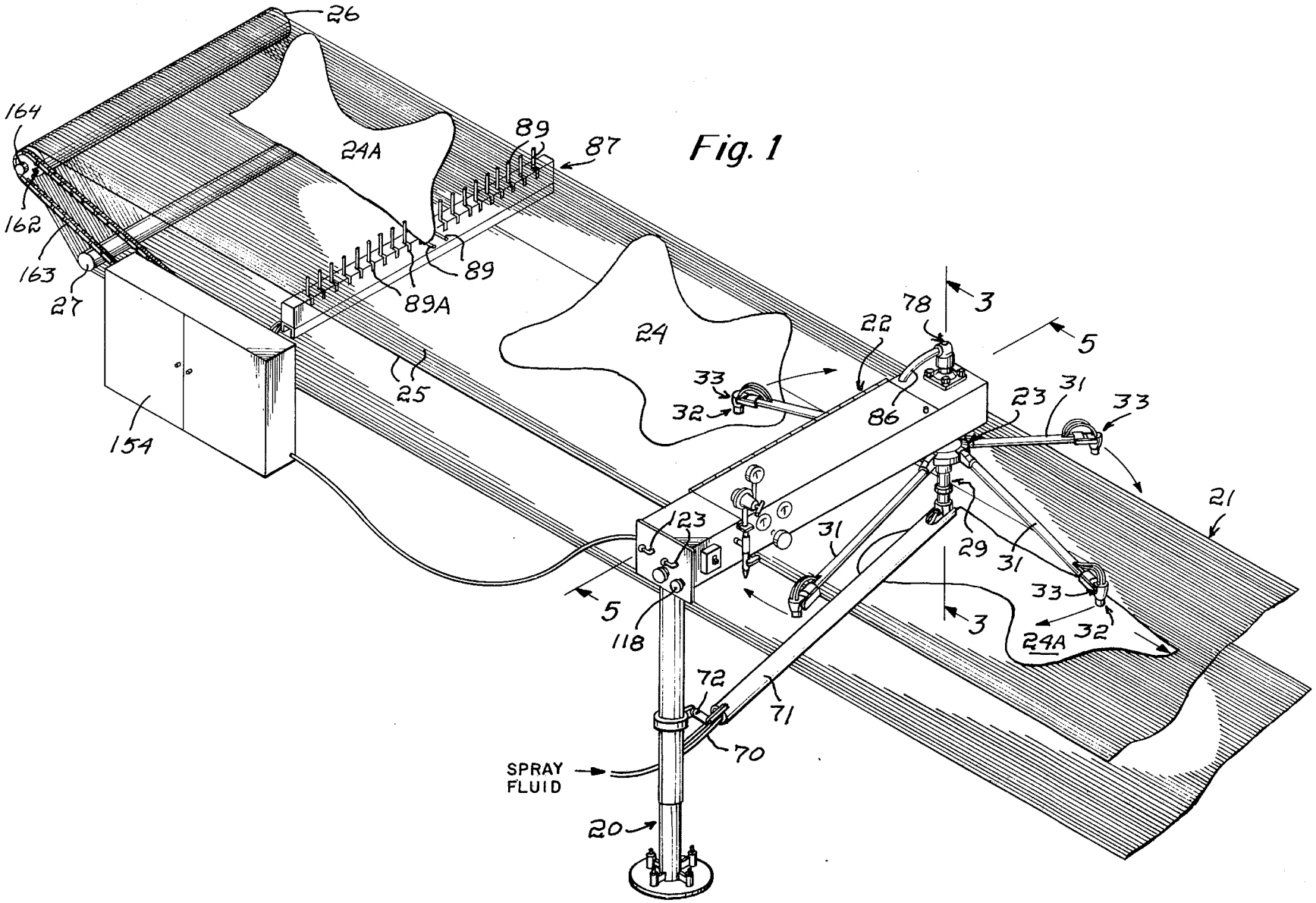
FIG. 1 is a perspective view of an installation in which the apparatus is used to spray hides carried by a conveyor.

As shown in FIG. 1, apparatus in accordance with the invention has a vertical stand 20 at one side of a conveyor, generally indicated at 21, and a housing, generally indicated at 22, extending transversely of and a substantial distance above the conveyor and in support of a rotatable spray unit, generally indicated at 23.

The conveyor 21, in the disclosed embodiment, is for use in carrying hides 24 and half hides 24A, for one example, under the spray unit 23 there to receive a coat and then carry the coated hides or half hides through a dryer (not shown). The conveyor is not detailed and its drive not shown as both are or may be of any conventional type depending on the type of sensing units employed. Because of the type of sensing units that are employed in the disclosed embodiment, the conveyor 21 is of the type consisting of a substantial number of endless members 25 trained about rolls such as the rolls 26 and 27 at each end to provide upper and lower courses with the upper course travelling from left to right as viewed in FIG. 1.

The spray unit 23 has a vertical shaft including, see FIG. 3, an upper portion, a lower portion generally indicated at 28 and 29, respectively, and an intermediate flange 30 in support of a series of arms 31, each provided with a spray head, generally indicated at 32 at its outer end. In the embodiment of the invention under consideration, both spray material and atomizing air are delivered to each spray head 32 and each spray head 32 is provided with a normally closed, spray control valve generally indicated at 33, see FIGS. 8 and 9, and later described but here noted as operated by air under pressure. In the disclosed embodiment, there are four arms 31 to simplify the drawings although the use of eight arms is preferred as shown in U.S. Pat. No. 3,908,592.

The shaft portion 28 extends vertically through the top wall 34, the bottom wall 35 and an intermediate parallel partition 36 of the housing 22 and is rotatably supported by ball bearing units 37, one mounted on the top wall 34 and the other on the partition 36 between which is a sprocket 38 supported by the shaft portion 28 in a manner permitting it to turn independently thereof with a spring biased pawl 39 in engagement with a ratchet wheel 40 fixed on the shaft portion 28.

The flange 30 is shown as having ears 30A. Each arm 31 has, at its inner end, a mount 41, the mounts pivotally connected to the ears 30A and having a shoulder 42 through which is threaded an adjustable stop 43 in engagement with a seat 30B in the undersurface of the flange 30 thus to permit the angle of the arms 31 to be varied.

Figure 5:
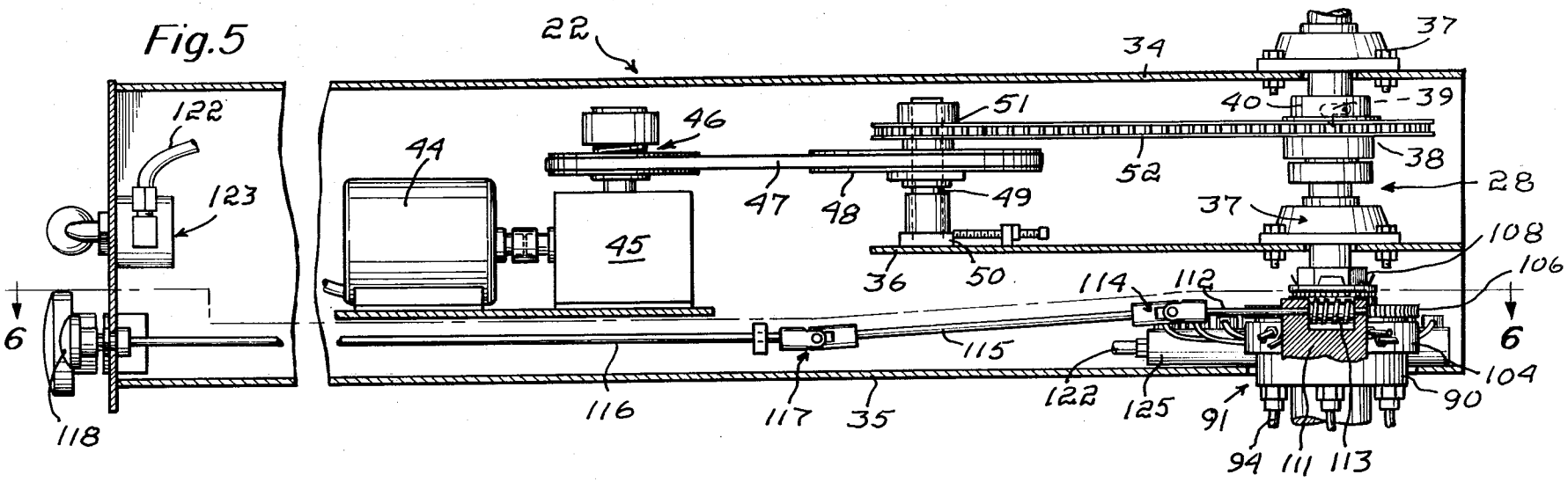
FIG. 5 is a section taken approximately along the indicated line 5—5 of FIG. 1.

As shown in FIG. 5, an electric motor 44 is mounted within the housing 22 and is connected to the drive shaft of a gear box 45 having a Reeves pulley 46 on its driven shaft connected by a belt 47 to a pulley 48 fast on a vertical shaft 49 rotatably supported by a mount 50 adjustably connected to the partition 36 for movement lengthwise of the housing 22. The shaft 49 is also provided with a sprocket 51 connected to the drive shaft sprocket 38 by a chain 52. The pawl and ratchet connection between the sprocket 38 and the shaft portion 28 permits the shaft to be turned manually in the same direction.

The shaft portion 28 has a section 28A of increased diameter providing a shoulder 53 below the bottom wall 35 of the housing 22 and the flange 30 is secured to the lower end of the section 28A.

The lower shaft portion 29 includes a flanged section 54 secured to the undersurface of the flange 30 and having an axial chamber 55 provided with a counterbore in which is threaded the upper end of the holder conduit section 56 of the rotary fluid supply joint, generally indicated at 57. The flange of the section 54 has radial bores 58, one for each arm 31 and opening into the chamber 55. A conduit 59 extending through each arm 31 connects a bore 58 to the port 60 of the appropriate spray head 32, see FIGS. 7 and 8.

The holder section 56 has a downwardly opening seat 61 and a bushed tube 62 extends through it with its flanged upper end clamped between the section 54 and the threaded end of the holder section 56. The bushed tube 62 also extends through the flanged section 63 which is the other part of the rotary joint 57, the flange of the section 63 held in the seat 61 between antifriction washers 64 and 65 by a retaining ring 66.

The shaft section 63 is so counterbored as to receive packing 67 and the threaded end of an end cap 68 which is seated against the packing 67. The passage 69 through the end cap 68 opens laterally and a conduit 70 from a suitable source of spray material (not shown) is supported by and extends through a tubular arm 71 pivotally linked as at 72 to the lower end of the support 20 with its other arm in the form of a clevis connected to the end cap 68 by a pivot 73 whereby the joint section 63 is held against turning.

Figure 7:
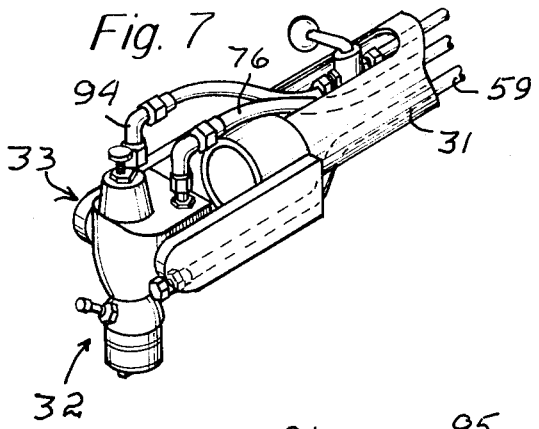
FIG. 7 is a perspective view of one of the spray heads.
Figure 8:
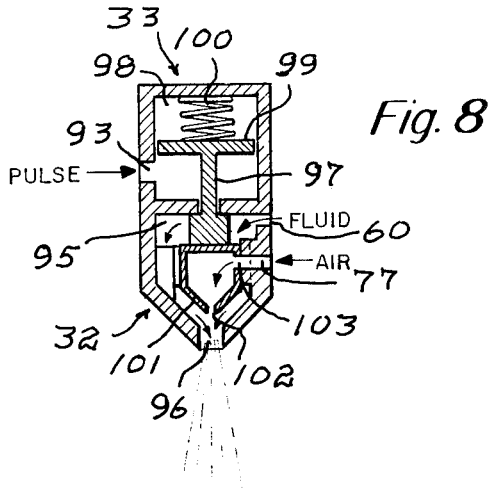
FIG. 8 is a schematic view thereof.

Turning now to the upper shaft portion 28, it will be seen from FIG. 3 that it has an axial bore 74 extending from its upper end into the section 28A where it has radial bores 75, one for each arm 31 and a conduit 76 is connected to each bore 75 and extends through the associated tubular arm 31 and is connected to the port 77 of the spray head 32 carried by that arm, see FIGS. 7 and 8.

Figure 9:
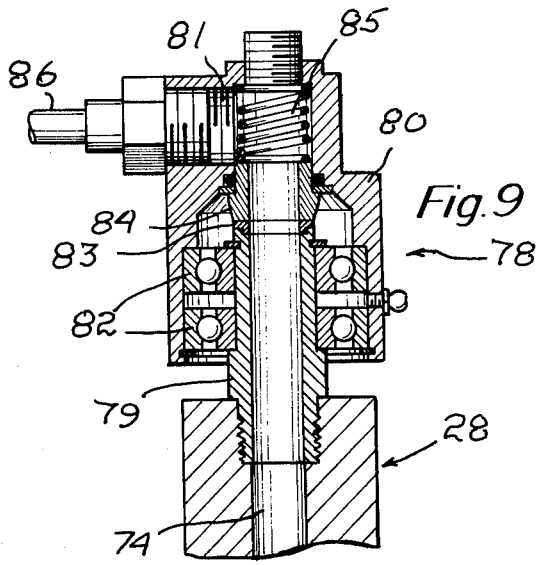
FIG. 9 is a vertical section through the rotary joint for atomizing air.

A rotary spray atomizing air joint, generally indicated at 78 has, see FIG. 9, a tubular conduit 79 threaded in the upper end of the bore 74 and is entrant of the other joint part which is a cap 80 having a laterally opening port 81. Ball bearing units 82 have their inner races carried by the conduit 79 and their outer races within and held by the cap 80. An antifriction seal 83 is held by a tubular section 84, sealed to the cap 80 and backed by a spring 85. A conduit 86 from a suitable source (not shown) of air for atomizing the coating liquid extends upwardly and into and through the housing 22 and then upwardly through the top wall 34 and is connected to the port 81, the conduit 86 holding the cap 80 against turning with the shaft.

In general, the apparatus, as thus far described, is of the type disclosed in U.S. Pat. No. 3,908,592 and attention is now directed to the infeed end of the conveyor 21 where there is located means sensing the presence of hides and including a housing 87 extending transversely of the conveyor between its courses and provided with a series of sensing units generally indicated at 88, each unit including a pair of fingers 89, each finger extending upwardly between two of the endless members 25 of the conveyor. In the disclosed embodiment, there are ten such units 88, by way of example and not of limitation. The series of sensing units thus, in effect, divide the conveyor 21 into ten lengthwise sections and each unit is operated if any part of a hide engages either of its fingers 89.

Before detailing the sensing units 88, reference is again made to the rotatable spray unit 23 which includes a ring 90 of a rotary control air joint, generally indicated at 91, the ring 90 seated against the shoulder 53 of the shaft section 28A and locked to the shaft 28 to turn therewith. The ring 90 has vertical bores 92, one for each arm 31 and connected to the port 93 of the spray control valve 33 of the appropriate one of the spray heads 32 by a conduit 94.

It will be seen from FIGS. 7 and 8 that each spray head 32 has a chamber 95 with a nozzle or outlet port 96 and the spray fluid inlet port 60. The stem 97 of the air operated valve 33 extends downwardly from an upper chamber 98 provided with the port 93 below the head 99 which is normally urged downwardly by a spring 100. The stem 97 is provided with a chambered valve element 101 within the chamber 95 and having a restricted outlet port 102 in alignment with the nozzle 96 and an inlet port 103 that is normally closed but which, on actuation of the valve 33 by air delivered into the upper cylinder 98 unseats the valve element 101 and brings its port 103 into registry with the spray fluid port 60.

The control ring 104 of the air control joint 91 is separated from the shaft portion 28 by a bushing 105 and has a worm gear 106 attached to its upper surface. A concave spring washer 107 engages the upper surface of the ring 104 and is held under pressure to ensure its sealing engagement with the ring 90 by means of a nut 108 threaded on the shaft portion 28 with a ball bearing unit 109 interposed between the nut 108 and the washer 107, the nut conventionally locked as at 110.

Figure 6:
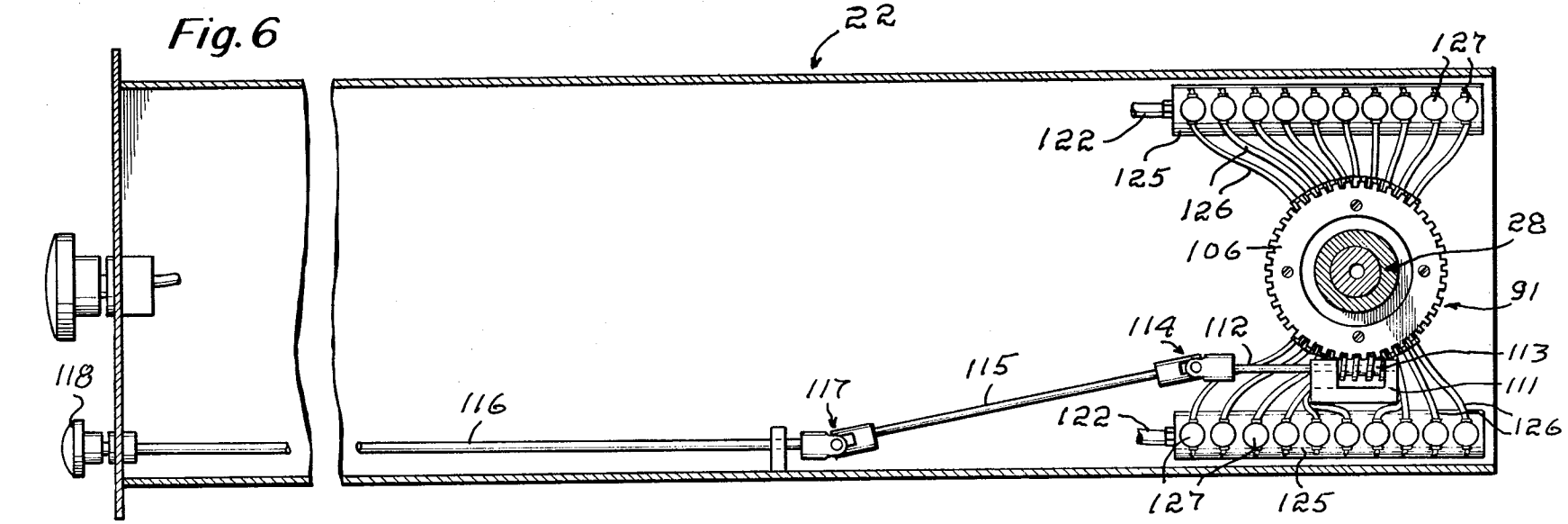
FIG. 6 is a section taken approximately along the indicated line 6—6 of FIG. 5.

As will be seen from FIGS. 5 and 6, a mount 111 within the housing 22 rotatably supports a shaft 112 provided with a worm 113 meshing with the worm gear 106 and thus holds the control ring 106 from turning with the spray unit 23. The worm shaft 112 is connected by a universal joint 114 to an intermediate shaft 115 which, in turn, is connected to a shaft 116 by a universal joint 117, the shaft 116 extending through the front wall or panel of the housing 22 and provided with a knob 118 enabling the position of the ring 104 of the control air joint 91 to be adjusted relative to the lengthwise conveyor sections established by the sensing units 88.

The stationary air control ring 104 has, see FIG. 4, two series of ten arcuately arranged inlet ports 119 with which the bores 92 of the ring 90 successively register as the unit 23 rotates, one series of ports 119 to control spray head operation while they are traversing the left hand, upstream portion of the conveyor 21 and the other series for like use while the path of the spray heads is over the right hand or downstream conveyor portion and each series is shown as having an additional port 120 at each end which is provided for air relief purposes. The ports are relatively narrow radial slots of sufficient length so that each has the desired cross sectional area but with sharper air cut-off than would result with circular ports. In the described embodiment, the ports 119 are spaced 9° apart and the arcuate distance between the centers of the two end ports 119 is 81°.

Figure 2:
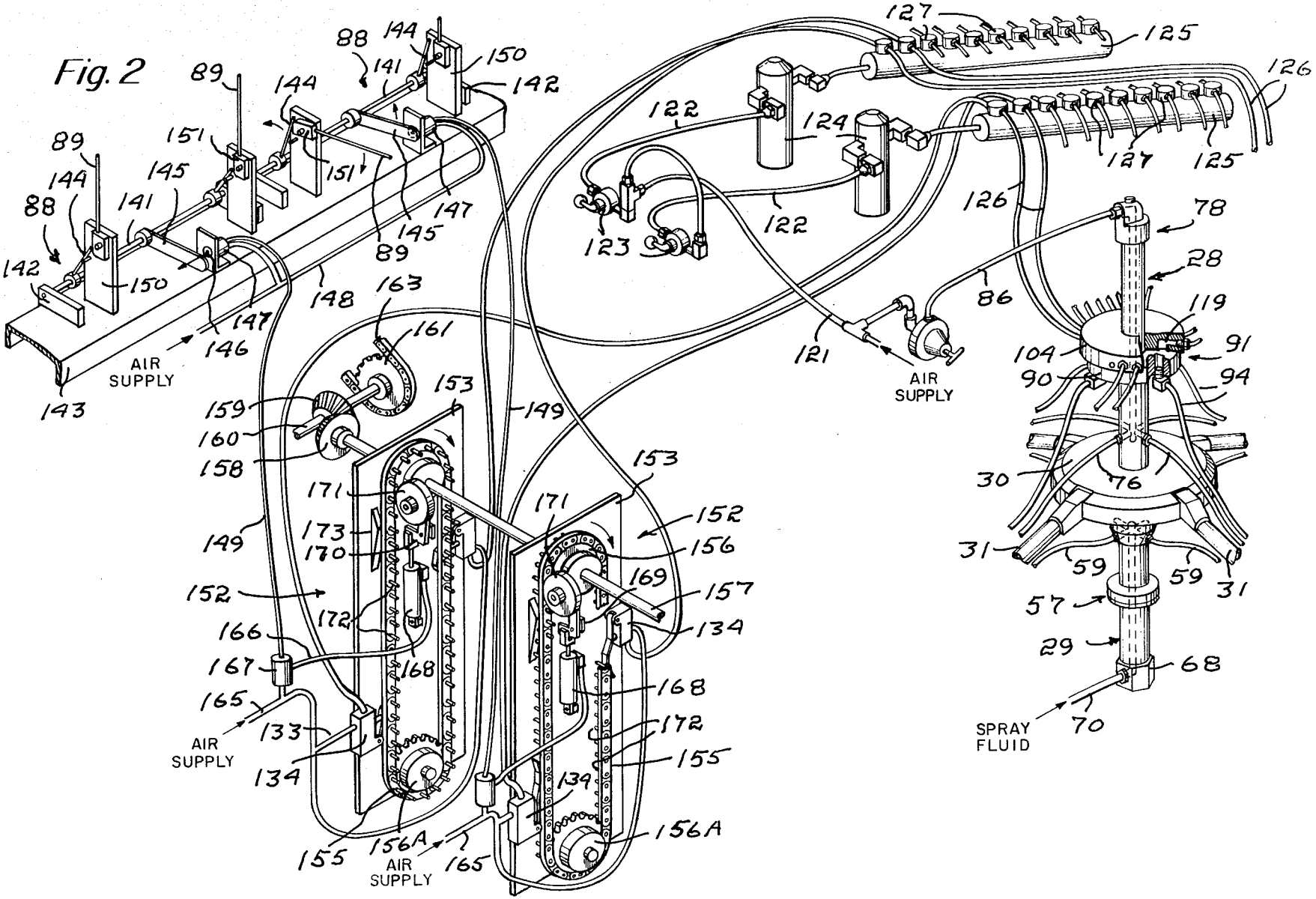
FIG. 2 is a schematic fragmentary view of the apparatus with some of its components shown in perspective.

Reference is now made to FIGS. 2 and 5 where a conduit 121 from the air source leads into the housing 22 where it is provided with two branches 122, each provided with a shut-off valve 123, an oiler 124, and in communication with a manifold 125. Each valve 123 is mounted on the interior surface of the front or panel end of the housing 22 with its handle exposed and each manifold 125 is located at the other end of the housing 22, one on each side of the stationary ring 104 of the rotary air control joint 91.

Each manifold 125 has a series of conduits 126, one for each of the ten ports 119 of the appropriate one of the two series thereof and in communication therewith. Each conduit 126 includes a three way air delivery or operating valve 127 and these, in the disclosed embodiment of the invention are shown as attached to the manifolds rather than to the ring 104. The valves 127 in control of the delivery of air from one manifold 121 are for use in operating the spray control valves 33 for upstream spraying and the valves 127 of the other manifold for like use in the case of downstream spraying.

Figure 10:
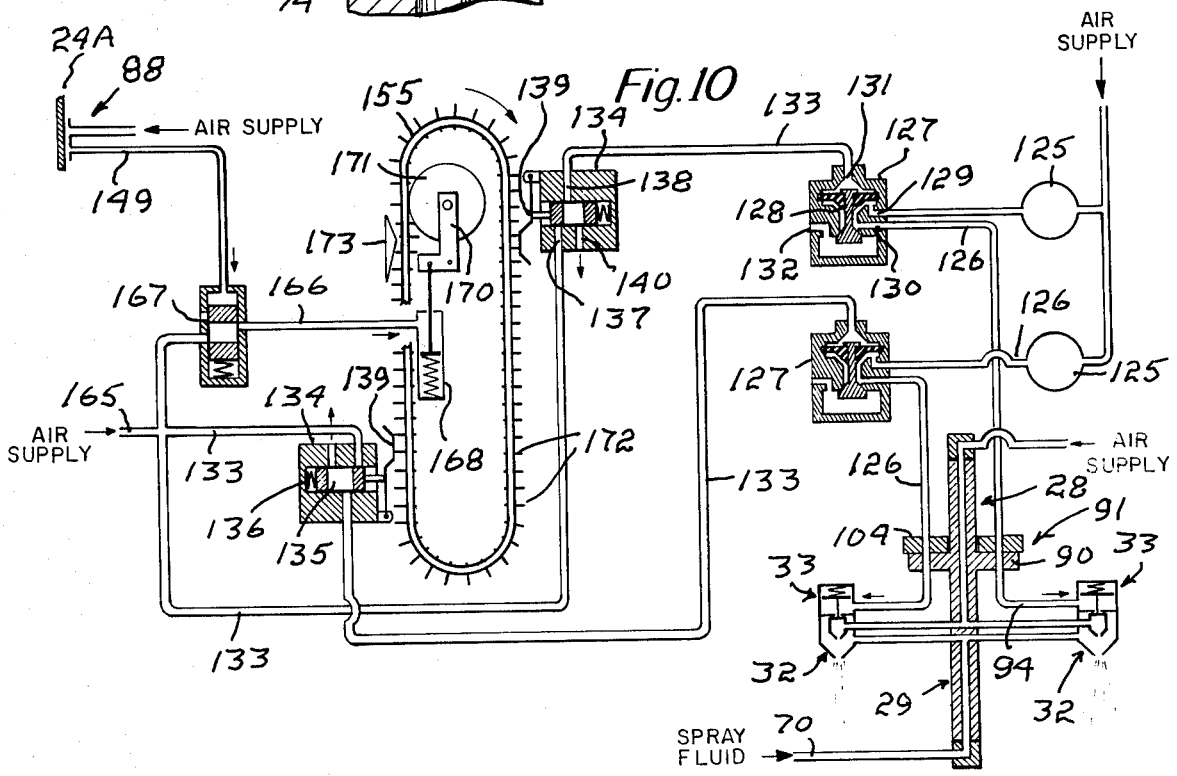
FIG. 10 is a schematic view showing air and operating valves and their relationship.

Each air delivery valve 127 is of the type schematically shown in FIG. 10 having its valve element 128 normally positioned by line pressure to place the inlet port 129 in communication with its outlet port 130 thus to deliver air to a ring port 119 but, when air is delivered into its operating port 131, the valve element 128 places the outlet port 130 in communication with the exhaust port 132 thus opening the associated ring port 119 to relief.

The invention provides a separate control for each air delivery valve 127, each including a sensing unit 88 and operated thereby to prevent delivery of air to a ring port 119 unless a part of an article is on the conveyor section represented by that control and within the spray path. To that end, each control includes two conduits 133, one for each series of ports 119, each conduit 133 having an operating valve 134 and in communication with the operating port 131 of an air delivery valve 127.

Each valve 134, see FIG. 10, is shown schematically as of a type having its valve element 135 normally held by a spring 136 to place its inlet port 137 in communication with the outlet port 138 but movable by the operating arm 139 into a position closing the inlet port 137 and placing the outlet port 138 in communication with the exhaust or relief port 140 relieving the pressure that held the associated valve 127 open to relief so that it returns to its normal position, air then delivered to the associated ring port 119.

Each sensing unit 88, see FIG. 2, in which but two of the ten units are shown has a shaft 141 rotatably held by supports 142 on a base 143 within the housing 87. Each shaft 141 has two arms 144 and an interrupter blade 145 and these bias their shaft 141 so that the interrupter blade 145 is normally below the outlet 146 of an air control unit 147 receiving air under pressure via a conduit 148. The control unit 147 of each sensing unit 88 has a signal conduit 149 and if and as long as the blade 145 intersects the air jet at the outlet 146, feedback air is diverted as a signal through the signal conduit 149.

Each unit also includes a pair of supports 150 to each of which a sensing finger 89 is pivotally connected to and extends through a slot 89A in the housing 87, the slots dimensioned to permit the fingers 89 to be pivoted by a passing part of a hide 24A, from a vertical position to a substantially horizontal position. Each finger 89 includes a counterweight 151 yieldably holding it upright and against which the appropriate one of the arms 144 rests and which serves to so cam the engaged arm 144, when and while the associated finger 89 is pivoted forwardly and depressed by a part of a hide that the shaft 141 is turned a short distance in the opposite direction to bring its blade 145 into its operative position relative to the outlet 146 intersecting the air jet with a signal created in the conduit 149 resulting. It will be appreciated that each finger of a unit 88 functions independently of the other finger and that the use of plural fingers for each unit is for the purpose of reducing the number of operating valves 127 and the means by which they are controlled.

The air signals from the sensing units 88 are relatively weak but are adequate to control the operation of actuators, generally indicated at 152 for the operating valves 127 and mounted on vertical partitions 153 within a cabinet 154 at one side of the conveyor 21, see FIGS. 2 and 5.

On each side of each partition 153 there is a chain 155 trained about sprockets 156 and 156A. There is one such chain for each of the sensing units 88. The sprockets 156 are fast on a shaft 157 rotatably supported by the partitions 153 and having a bevel gear 158 in mesh with a like gear 159 on a shaft 160 provided with a sprocket 161 shown in FIG. 1 as connected to a sprocket 162 by a chain 163, the sprocket 162 shown as fixed on the end of the shaft 164 of the conveyor roll 26 or otherwise driven so that the travel of the chains 155 always has a predetermined relation to the rate at which the conveyor 21 is travelling.

As there are two operating valves 127 for each control unit, the conduits 133 are branches of an air supply conduit 165 for each valve actuator 152 and each air supply conduit includes a third branch 166 provided with a normally closed control valve 167 of a type capable of being opened by signals from the appropriate sensing unit 88 and delivered thereto by the associated signal conduit 149. The third branch 166 is connected to the cylinder of a piston-cylinder unit generally indicated at 168 of a type having its stem normally extended and retracted when the valve 167 is open as it is when and as long as a signal exists. A partition supported bracket 169 pivotally supports a bell crank lever 170 one end of which is pivotally connected to the stem of the unit 168 and the other end of which rotatably supports a wheel 171. When the piston cylinder unit 168 is air operated, the wheel 171 is brought close to the chain 155.

Figure 11:
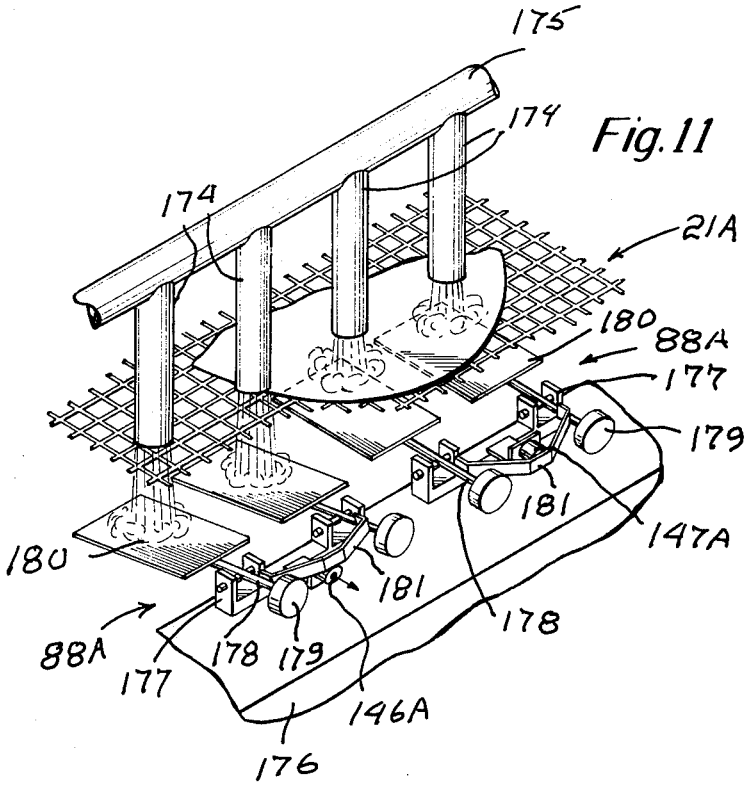
FIG. 11 is a perspective view of another sensing unit.

The pivot pins 172 connecting the links of the chains 155 are relatively long and are slidably held for movement between first positions in which they protrude from one side, then to be engaged by the wheel 171 if the piston-cylinder unit 168 has been operated in response to a signal to bring the wheel 171 into a position so to do and forced into their second position in which they so protrude from the other side that they engage successively the actuating arms 139 of the two operating valves 134. The number of thus shifted pins 172 correspond to the length of the signal from the associated sensing unit 88 and the location of the valves 134 relative to the wheel 171 represents the distance between the sensing unit and the spray path. In that connection, it will be noted that such locations vary because both parts of the spray path are arcuate. A partition supported cam 173 is engaged by any pin 172 in its second position and returns it to its first position after it has passed the second valve 134.

in FIG. 11, sensing units, generally indicated at 88A, are shown that may be used with the conveyor 21 or a reticulated conveyor, a fragment of which is schematically indicated at 21A.

Each unit 88A includes a pair of downwardly disposed air tubes 174 supported by a header 175 extending transversely of the conveyor 21A in positions such that they establish lengthwise conveyor sections of predetermined widths and enable the hides or half hides to pass freely over them. As the path of the spray heads is circular with the center in the middle of the conveyor, the lengthwise sections are widest centrally of the conveyors 21, 21A and decrease to a minimum at the margins thereof.

Each unit 88A includes a support 176 below the upper course of the conveyor 21A and each support 176 includes a pair of holders 177. Each holder 177 pivotally supports an arm 178 having at one end a counterweight 179 and at its other end a vane 180 disposed in a position such that the air jet from the appropriate one of the tubes 174 impinges thereon. The counterweight ends of the arm 178 of each unit 88A are interconnected by an interrupter 181 held by the air stream impinging on both vanes 180 out of the path of the air jet from the outlet 146A of an air control unit 147A, the conduits to and from which are omitted to simplify the drawing.

When a part of a hide intercepts the air jet from either one or both tubes 174, the counterweights 179 drops the interrupter 181 into a position interrupting the air jet from the air control unit 147A with an air signal generated and utilized in the same manner as those derived from the operation of the sensing units 88.

From the foregoing, it will be apparent that the air delivery valves 127 block the delivery of air to the two arcuate series of ports 119 of the ring 104 of the rotary air control joint 91 and thus the spray control valves 33 remain closed as long as the operating valves 134 are open. When, however, a signal is delivered by the sensing device 88 of a control, the operating valves 134 of that control are set to relieve the holding pressure on the delivery valve 127 on an appropriately delayed basis then to permit the spray control valves 33 to be opened for the required interval.

By way of summary, each sensing unit 88 provides signals by which the delivery of air to the ports 119 is controlled. There are two series of ports 119 in the disclosed embodiment of the invention, ten ports in each series, one series for use in upstream spraying and the other for use in downstream spraying and either or both may be in use as determined by the operator.

The signal from any one of the ten sensing units 88, accordingly, must be capable of controlling separately the delivery of air to the two series of ports 119. To that end, each unit 88 has control of two identical air flow systems, one for each series of ports 119 and each such system includes a conduit 133, a valve 134 and the appropriate one of the valves 127 by which the air supply to the spray heads is controlled. The signal from each unit 88 effects the operation of an actuator 152, of which there is one for each unit 88, and includes the chain, the pivot pins 172 of which are set by the operation of the piston cylinder unit 168 of the actuator 152, when a signal opens the associated valve 167, the thus set pins operating both valves 134 successively.

We claim:

1. Apparatus for spraying a fluid on articles being carried on a conveyor, said apparatus including a vertical shaft, a series of spray heads, means connected to said shaft and supporting said spray heads at a distance therefrom and from each other to provide a wanted spray path as the shaft turns, means to rotate said shaft, said shaft including at least one rotary spray fluid joint including a stationary part having a port, a spray fluid delivery conduit in communication with said port, the other joint part turning with the shaft and having a series of ports, one for each spray head all in communication with the port of said stationary part, spray delivery means for each spray head and including a conduit effecting communication between said spray head and the appropriate one of said series of ports and a normally closed spray control valve opened by air under pressure then to permit spraying, said shaft also including a rotary air delivery joint including a stationary part and a part turning with said shaft and having a series of ports, one for each control valve in communication therewith, a series of controls, each including a sensing unit, said units arranged as a series extending transversely of the conveyor and establishing a like number of lengthwise conveyor sections, each unit operated while a part of an article is passing, the stationary part of said air delivery joint having at least one arcuate series of ports with which the ports of the other part thereof successively register as the shaft turns, one port of said arcuate series for each of said controls, a series of air delivery conduits, one for each control, and each in communication with the appropriate one of the ports of said arcuate series and including an air delivery valve having air delivery and air relief positions, each control including means to operate the associated air delivery valve to effect its air delivery position while any spray head is traversing the associated lengthwise conveyor section when and while a part of an article is in the spray path, otherwise to effect said relief position, and said series having an additional port open to relief, at least at the trailing end thereof.

2. The apparatus of claim 1 in which each delivery valve is a three way valve having inlet and outlet ports in communication in a first position and a relief port in communication with the outlet port in a second position, and each control includes operating means operable to control the associated delivery valve to effect its second position and the control includes means operated by the sensing unit thereof to operate said holding means to effect the second position of said associated delivery valve except at the time and for the interval that the sensed article path is within the spray path.

3. The apparatus of claim 2 in which said delivery valve includes means by which the first position is normally effected and also has an operating port to receive air under pressure then to overcome said valve means to effect said second position, and the operating means of the associated control includes an air delivery conduit in communication with said operating port and a three way operating valve having a normal position open with respect to said operating port, and the means operated by the sensing unit of said control effect the shifting of said operating valve into a position delivering pressure to the operating port of the associated delivery valve.

4. The apparatus of claim 1 in which there are two arcuate series of ports, the arcuate extent of each series in terms of degrees being substantially equal to that part of the path of the spray heads in which spray is to be delivered.

5. The apparatus of claim 4 in which the arcuate extent of the arcuate series of ports is in the neighborhood of 81°.

6. The apparatus of claim 4 in which the edges of the ports of both parts of the rotary air delivery joint that coincide in shutting off air delivery are straight and radial.

7. The apparatus of claim 4 in which the ports of both parts of the rotary, air delivery joint are in the form of radial, straight sided slots, the length and width of which establish a cross sectional area appropriate for the cross sectional area of the air delivery conduits.

8. The apparatus of claim 4 in which each arcuate series of ports includes a relief port at each end.

9. The apparatus of claim 4 in which the stationary part of the rotary air delivery joint includes a worm gear, and the apparatus includes a shaft and a worm on said shaft in mesh with and normally holding said worm gear against turning with said shaft but enabling said stationary part to be turned by said worm shaft to position the arcuate series of ports relative to the lengthwise conveyor sections.

10. The apparatus of claim 4 and a housing in support of the upper end of the shaft, the stationary part of the rotary air delivery joint is within the housing, an air supply conduit is provided for each arcuate series of parts, each including a valve attached to the housing and a manifold within the housing, and the air delivery conduits for said series of ports are in communication with the manifold.

11. The apparatus of claim 10 in which the air delivery valve of each air delivery conduit is attached to the appropriate manifold, and the manifolds are positioned in the housing closed to said air delivery joint, one on each side thereof.

12. The apparatus of claim 1 in which each sensing unit establishes a lengthwise section of the conveyor of a particular width, the ones in the side portions of a width less than ones in the central portion of the conveyor.

13. The apparatus of claim 1 in which the conveyor includes a series of lengthwise endless members and each sensing unit includes a pair of fingers, each extending upwardly between a different pair of endless members, and supported to be depressed by a part of an article then to effect operation of the associated control.

14. The apparatus of claim 1 in which each sensing unit includes means delivering jets of air downwardly through the conveyor and means below the conveyor of a type delivering a signal to the control of which it is a part but held against so doing by said jets until interrupted by a part of an article.

15. The apparatus of claim 14 in which the means below the conveyor include a support, a pair of arms pivotally connected to said support, each arm including a counterweight at one end normally maintaining said arm in a first position and a vane at its other end so disposed that the appropriate one of the jets of air impinges thereon unless a part of an article intercepts that air jet, an air control provided with an outlet and a signal conduit, and an interrupter connecting the counterwieghted ends of the arms and normally held by said counterweights if either one or both of the air jets is intercepted, in a position blocking said outlet and directing air through said signal conduit.

* * * * *